United States Patent [19]

Scheerhorn

[11] 3,941,441

[45] Mar. 2, 1976

[54] DRAWER INTERLOCK SYSTEM

[75] Inventor: Douglas Scheerhorn, Grand Rapids, Mich.

[73] Assignee: Steelcase Inc., Grand Rapids, Mich.

[22] Filed: Jan. 2, 1974

[21] Appl. No.: 429,582

[52] U.S. Cl. ..... 312/215; 312/218; 312/319

[51] Int. Cl.[2] ..... E05B 65/46

[58] Field of Search ..... 312/215, 216, 217, 218, 312/276, 319

[56] References Cited

UNITED STATES PATENTS

| | | | |
|---|---|---|---|
| 1,285,209 | 11/1918 | Jones | 312/218 X |
| 2,842,419 | 7/1958 | Howard | 312/218 |
| 3,378,321 | 4/1968 | Frederick et al. | 312/215 |
| 3,401,998 | 9/1968 | Evans et al. | 312/215 |

*Primary Examiner*—Casmir A. Nunberg
*Assistant Examiner*—David H. Corbin
*Attorney, Agent, or Firm*—Price, Heneveld, Huizenga & Cooper

[57] ABSTRACT

The specification discloses a drawer interlock system for a drawer assembly having a plurality of vertical rows of drawers. Each vertical row is provided with an interlock mechanism to prevent opening of more than one drawer at a time. Means are provided for interconnecting the interlock mechanisms for the different vertical rows of drawers to thereby prevent the opening of more than one drawer at one time in any of the adjacent rows of drawers.

21 Claims, 10 Drawing Figures

DRAWER INTERLOCK SYSTEM

BACKGROUND OF THE INVENTION

The present invention relates to safety drawer interlock arrangements which allow a cabinet user to open only one drawer at a time to thereby prevent the cabinet from tipping over.

In cabinets having a plurality of drawers, particularly relatively narrow and high cabinets such as file cabinets containing heavy items in each of the drawers, it is desired to prevent more than one drawer from being extended at one time. If two or more drawers are opened it is possible that the cabinet can topple over. Some prior art interlock systems employ a rotatable rod extending vertically in the cabinet and coupled to a spring-loaded engaging mechanism. When a drawer is opened the rod rotates and locks the remaining drawers in a closed position. Other systems employ a flexible ribbon or cable interconnected to each of the drawers and which has sufficient slack to permit full extension of one drawer but will not allow the remaining drawers to be extended. While such systems are satisfactory, the art heretofore known has failed to recognize that such mechanisms do not provide suitable interlocking arrangements for cabinets having more than one row of drawers. Prior art systems presently known are single row systems wherein only one drawer per row can be opened. In systems where two or more rows of drawers are provided, drawers can be opened in each row simultaneously and can tip forward possibly injuring the person standing in front of the cabinet.

SUMMARY OF THE INVENTION

The present invention prevents the simultaneous opening of two or more drawers in a cabinet assembly having two or more adjacent rows of drawers. The invention employs a mechanism which can be fitted within a cabinet and on the drawers to provide a durable and yet inexpensive system for preventing such opening. The apparatus may be installed as an integral part of a new cabinet or can be added to existing cabinet structures. Preferably the invention mechanism comprises a continuous cable extending from one row to an adjacent row which is fixed at the ends thereof. Means are provided on the drawers for operably coacting with the cable whereby opening of one drawer takes up the slack in the cable and no other drawers can be opened.

The many important objects and advantages of the invention will become more fully appreciated by those skilled in the art upon reading the following description with reference to the accompanying drawings illustrating a preferred embodiment thereof.

DETAILED DESCRIPTION OF THE PREFERRED EMBODIMENT

Figure 7:
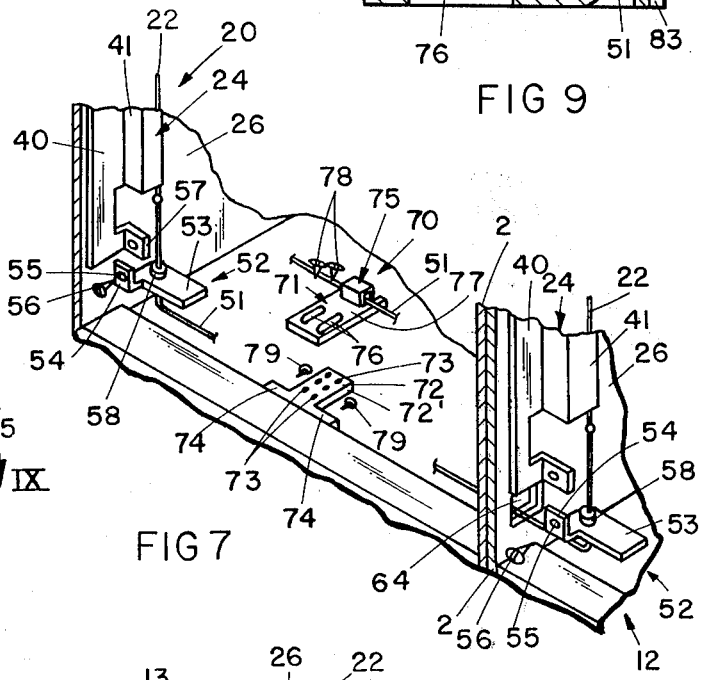
FIG. 7 is a fragmentary exploded perspective view of the interconnecting mechanism and an adjustment mechanism for the interconnecting means.
Figure 5:
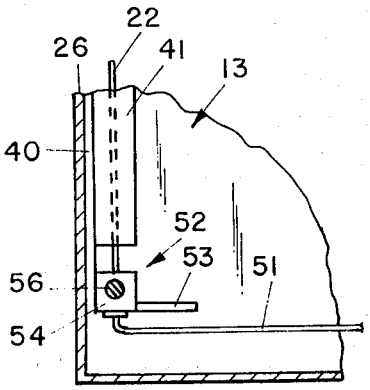
FIGS. 5 and 5*a* are fragmentary views partially in cross section taken in the area of the circles designed V and VA respectively of FIG. 1 illustrating the interconnection between a first row of drawers and an adjacent row of drawers.
Figure 5A:
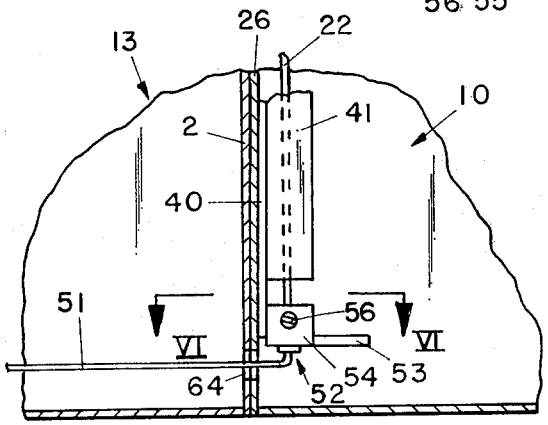
Figure 2:
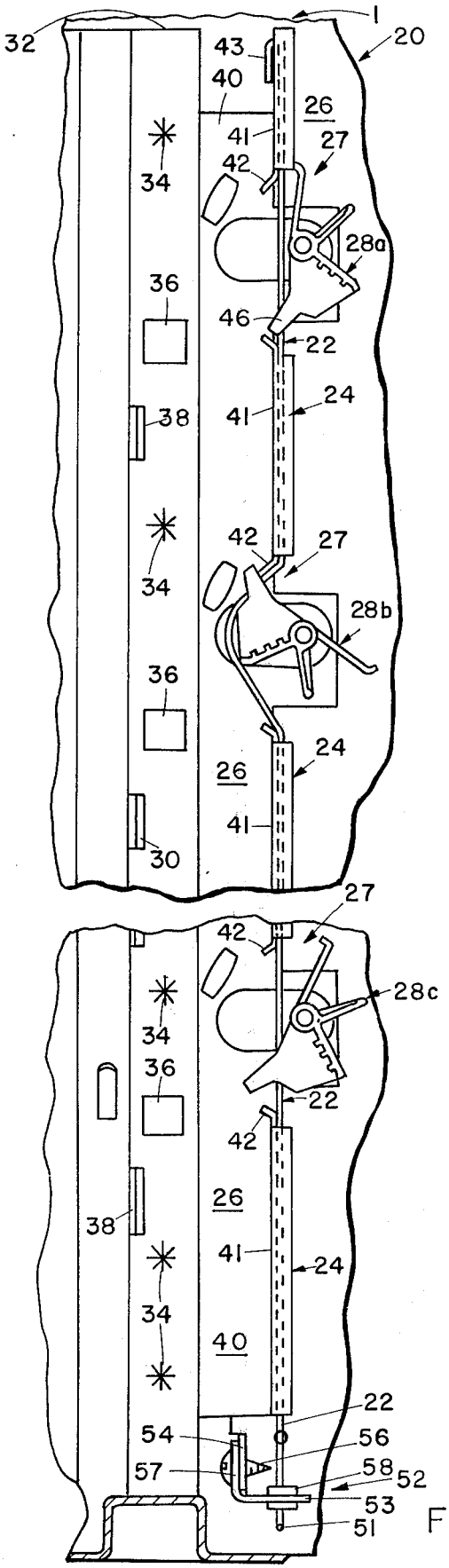
FIG. 2 is a fragmentary cross-sectional side elevation view of the interlock apparatus as taken generally along the plane II—II of FIG. 1.

The drawer interlock mechanism of the invention is utilized in cabinet assemblies 1 having a plurality of drawers 12 and 14 arranged in adjacent rows 10 and 13 respectively. The drawer interlock system allows one to open only one drawer at a time. With one drawer 12 opened in a row 10 for example, one is not only unable to open any drawer 12 in that row but also is unable to open any drawer 14 in adjacent row 13. A drawer interlock mechanism 20 is positioned adjacent each vertical row of drawers 12 and 14 within the cabinet 1 (FIG. 2). The interlock mechanisms are connected to each other by connecting means as a cable 51 (FIGS. 5, 5*a* and 7) for simultaneous operation.

Figure 3:
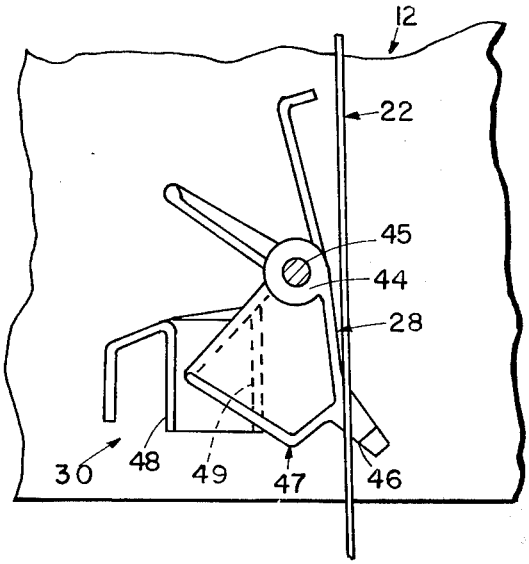
FIG. 3 is a fragmentary side-elevational view of one of the cam members of FIG. 2 taken from the side opposite that of FIG. 2 and showing the relationship of the cam member to a drawer catch with the drawer illustrated in a closed position.
Figure 4:
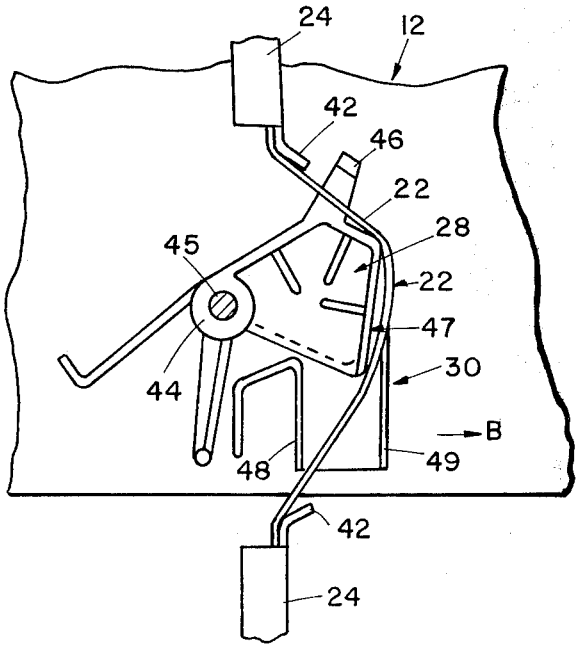
FIG. 4 is a side-elevational view of the apparatus shown in FIG. 3 with the drawer shown in the process of being opened.

The drawer interlock mechanisms 20 adjacent each row of drawers are identical and illustrated in FIGS. 2, 3 and 4. The interlock mechanism will be described only in sufficient detail for an understanding of the invention. For a more detailed discussion, reference may be had to the commonly assigned, copending application Ser. No. 281,421, entitled DRAWER INTERLOCK SYSTEM, invented by Frederick S. Faiks.

The interlock mechanism 20 includes a flexible cable 22 mounted vertically in a segmented guide 24 secured to the inside wall 26 of the cabinet 1. A plurality of cams 28 are rotatably mounted in the open space 27 between adjacent segments of guide 24. When a drawer 12 is opened a catch 30 thereon engages cam 28 and passes thereby. As catch 30 passes, it rotates cam 28 to the position of cam 28*b* shown in FIG. 2. This takes up all available slack in flexible cable 22 and prevents other drawers 12 from opening. Each cam 28 and catch 30 are designed to cooperate in such a way that if one attempts to open two drawers simultaneously all of the slack in cable 22 is taken up before either catch 30 is free to pass by its associated cam 28.

Guide 24 is formed integrally with a cabinet reenforcing and drawer suspension mounting bracket 32. Bracket 32 is vertically mounted to the interior wall 26 of the cabinet near the front thereof as by spot-welding 34. Bracket 32 includes a plurality of apertures 36 and flanges 38 for supporting drawer suspension members (not shown) for the file cabinet.

Bracket 32 further includes a wall portion 40 which with guide 24 comprises a guide wall 41 extending outwardly from wall 40 and having an overturned edge or lip 42. Guide 24 guides cable 22 which extends longitudinally therealong. Open spaces 27 between adjacent guide segments are positioned at each drawer level location. Guide wall 41 of guide member 24 is inwardly bent to form lip 42 on each side of each open space 27. When the cable is deflected inwardly by the action of cam 28 lip 42 provides a smooth support area.

Cable 22 may be a wire cable, a metal ribbon, a nylon cord or any other suitable ribbon of flexible, stretch resistant material. Hooks 43 are fixed or formed at opposite ends of cable 22 and are secured at an upper edge of segmented guide 24 over guide wall 41. Cable 22 extends downwardly through the guide, to a joining segment 51 which extends across a lower surface of the cabinet 1, and to another cable 22 which extends upwardly into the next adjacent row of drawers whose end is secured by means of a similar hook 43 at the upper portion of a corresponding guide 24 in the adjacent row of drawers.

Cam member 28 molded from a suitable polymeric material includes a center sleeve 44 having an aperture therein adapted to receive a screw 45 which mounts cam member 28 for rotation.

Referring to FIGS. 3 & 4 with the drawer closed as shown in FIG. 3 the slack in cable 22 is guideably positioned between a guide member 46 of cam 28 and cam arm 47 is positioned between walls 48 and 49 of catch 30. As the drawer is opened as illustrated in FIG. 4, the drawer 12 and catch 30 move in the direction indicated by arrow B and wall 48 of catch 30 causes cam member 30 to rotate in a counterclockwise direction causing the sidewalls of cam arm 47 to engage cable 22 and take up slack in the cable. The cam is then held in its rotated position to maintain the cable under tension. If a second drawer 12 is pulled outwardly, the cam 30 associated therewith is restricted from rotating since the taut cable 22 will not yield to permit rotation of the cam. Likewise if an attempt is made to open two drawers simultaneously the combined partial rotation of two cam members will cause the cable to become taut. This prevents further rotation of either of the cam members sufficiently to allow the drawer catch to clear the cam.

The interconnecting means of the present invention is illustrated in FIGS. 5, 5*a*, 6 and 7. A linking section 51 of cable extends between the cables 22 in each of interlock mechanisms 20 and is joined to them both. A guide member 52 is provided at the base of each vertical interlock mechanism 20 for purposes of guiding cable linking section 51 therebetween.

Guide 52 includes a bracket member 53 formed from sheet metal or the like to include an upwardly extending apertured tab 54. An opening 55 (FIG. 7) through tab 54 receives fastening means as a sheet metal screw 56 by which guide 52 is secured to a corresponding mounting tab 57 formed in segmented guide 24 proximate a lowermost portion of guide wall 41. Tab 57 is bent inwardly from the side wall 26 of cabinet 1 and receives sheet metal screws 56 to thereby secure guide 52 relative to segmented guide 24. An aperture through the planar surface of bracket 53 is lined with a bushing 58 to prevent excessive wear on the linking section of cable 51. Bushing 58 is preferably formed from molded nylon or other suitable lubricious material. Guide 52 at the base of row 12 is positioned adjacent an aperture 64 (FIGS. 5*a* and 7) formed in the sidewall or divider partition 2 of cabinet 1. Guide 52 at the base of row 13 is correspondingly positioned adjacent the left hand side wall. Guides 52 at each row of drawers therefor serve to guide linking cable member 51 along the lower interior of the cabinet assembly.

In order to adjust the tension of linking cable section 51 and cables 22 of adjacent interlock mechanisms 20, an adjuster 70 (FIG. 7) is provided at the bottom of row 13 of drawers 14. A guide member 71 is adjustably secured to a bracket 72. Bracket 72 includes a plurality of mounting holes 73 whereby the adjuster assembly can be fixed near the bottom of the cabinet at any one of several points by means of screws 78.

Bracket 72 is formed of sheet metal having sidewalls 72' for rigidity and a pair of outwardly extending ears 74 at the front thereof. Ears 74 are provided with suitable apertures (not shown) by which it is mounted to the lower interior framework of cabinet 1 by screws 79.

Figure 1:
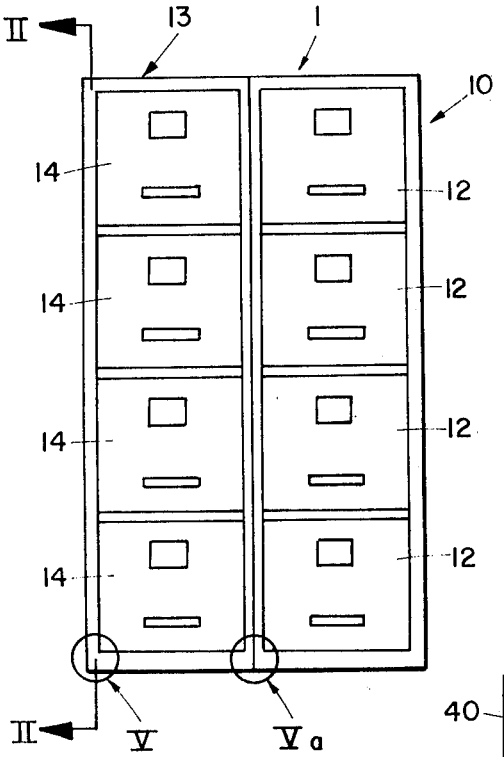
FIG. 1 is a front elevation of a cabinet assembly having two rows of drawers.
Figure 6:
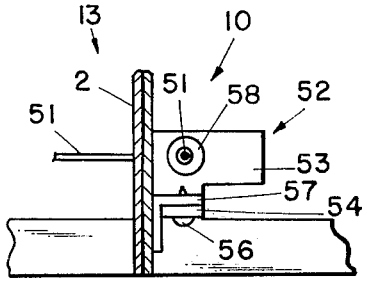
FIG. 6 is a fragmentary top plan view of the apparatus shown in FIG. 5.
Figure 9:
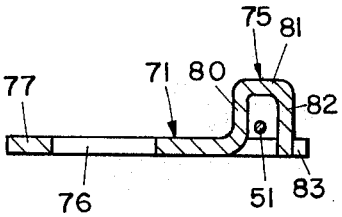
FIG. 9 is a cross sectional view of the adjustable guide member taken along the plane IX—IX of FIG. 8.
Figure 8:
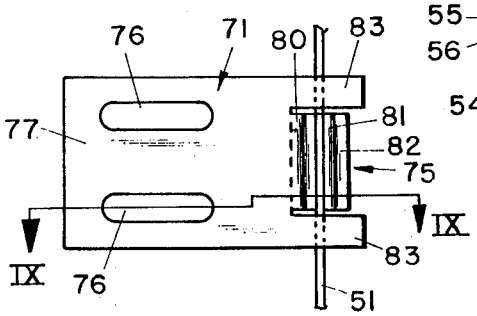
FIG. 8 is a bottom plan view of the adjustable guide member.

Guide member 71, shown in detail in FIGS. 8 and 9, is similarly formed from sheet metal having a body portion 77 through which a pair of spaced apart elongated slots 76 are formed to receive screws 78. Screws 78 passing through slots 76 and into apertures 73 of bracket 72 provide the means whereby the adjuster may be moved toward and away from the front of cabinet 1. A channel-like guide 75 is formed at one end of body 77 to retain and guide linking cable section 51. Guide channel 75 is formed generally centrally of body 77 to extend generally transversely of elongated slots 76. Guide channel 75 includes an upwardly extending inner wall 80, a top wall 81 and a downwardly formed outer wall 82. The guide channel is opened at the bottom to receive linking cable section 51. The portion of body 77 adjacent guide channel 75 extends slightly beyond outer wall 82 to form a pair of spaced apart outwardly extending retaining legs 83. Legs 83 engage linking cable section 51 and hold it within guide channel 75. When linking cable section 51 is slack it is prevented from falling out of channel 75 by legs 83. During preliminary assembly, linking cable section 51 is positioned in guide 75 by simply placing cable section 51 on the outer extremity of legs 83 adjacent outer wall 82. The portion of cable section 51 adjacent outer wall 82 is pulled downwardly between legs 83 and under outer wall 82 and slipped into the open bottom of guide channel 75. The linking cable is then slidably retained in guide channel 75 and the necessary tension adjustments can be made by moving adjuster 70 toward and away from the front of the cabinet. The provision of elongated slots 76 in adjuster 70 and the plurality of apertures 73 in bracket 72 allow a wide range of adjustment to thereby facilitate the adjustment of the tension on linking cable section 51 and cables 22 as required.

In operation when any one of drawers 12 or 14 is opened, catch 30 (FIGS. 3 and 4) engages with its associated cam 28 causing it to rotate thereby taking up slack in cable 22 in row 10, in linking cable section 51 and in the corresponding cable 22 in adjacent row 12 thereby preventing rotation of any other cam 28. This prevents the opening of any other drawer 12 or 14 in either row of drawers.

The interconnecting mechanism of the present invention can be installed as an integral part of a new cabinet assembly or can be added to existing cabinets having an interlock system. Those skilled in the art will also recognize that other arrangements of the invention can be provided. Accordingly, all modifications of the invention are to be considered as included in the appended claims unless these claims by their language expressly state otherwise.

The embodiments of the invention in which an exclusive property or privilege is claimed are defined as follows:

1. In a cabinet having at least two adjacent rows of drawers, each row including a plurality of drawers, a drawer interlock mechanism for allowing only one drawer in both said rows to be opened at any one time, said interlock mechanism comprising: first interlocking means located adjacent and along said first row of drawers for engaging each drawer in said first row; second interlocking means located adjacent and along said second row of drawers for engaging each drawer in said second row; each of said first and second interlocking means including movement restricting means for preventing the opening of all other drawers in said respective row when one of said drawers in that row is opened, each of said interlocking means being shiftable between a first operative condition in which said movement restricting means allow any one of its said associated drawers to be opened and a second operative condition in which said movement restricting means prevent the passage of the remaining drawers in said respective row so that drawers cannot be opened; each said drawer and its associated interlocking means including shifting means cooperating to shift said interlocking means from its first condition to its second condition as one of said drawers is opened; connecting means interconnecting each of said first and second interlocking means including means for shifting one of said interlocking means when the other of said interlocking means is shifted by said first mentioned shifting means whereby the shifting of either of said first and second interlocking means into its said second operative condition simultaneously shifts the other of said first and second interlocking means into its second operative condition.

2. The cabinet of claim 1 in which said connecting means comprises a cable interconnecting said first and second interlocking means.

3. The cabinet of claim 2 in which each of said interlocking means comprises a cable, each of said cables in each said interlock being flexible in its first operative condition and taut in its second operative condition, each of said cables of said first and second interlocking means being joined to said interconnecting cable of said connecting means.

4. The cabinet of claim 3 including adjusting means for adjusting the amount of slack available in said interconnecting cable of said connecting means.

5. The cabinet of claim 4 in which said adjusting means comprises a bracket engaging said interconnecting cable and mounting means mounting said bracket to said cabinet; said bracket including a plurality of mounting locations for operable engagement with said mounting means whereby the position of said bracket relative to said cable and said cabinet can be altered by positioning said mounting means at alternate ones of said mounting locations.

6. The cabinet of claim 5 including guide means positioned generally at the bottom of each of said first and second rows of drawers, said guide means extending generally parallel to its adjacent row of drawers and having an aperture therethrough; said interconnecting cable extending through said aperture and being guided thereby.

7. The cabinet of claim 2 including guide means positioned generally at the bottom of each of said first and second rows of drawers, said guide means extending generally parallel to its adjacent row of drawers and having an aperture therethrough; said interconnecting cable extending through said aperture and being guided thereby.

8. The cabinet of claim 2 including adjusting means for adjusting the amount of slack available in said interconnecting cable of said connecting means.

9. The cabinet of claim 8 in which said adjusting means comprises a bracket engaging said interconnecting cable and mounting means mounting said bracket to said cabinet; said bracket including a plurality of mounting locations for operable engagement with said mounting means whereby the position of said bracket relative to said cable and said cabinet can be altered by positioning said mounting means at alternate ones of said mounting locations.

10. The cabinet of claim 9 including guide means positioned generally at the bottom of each of said first and second rows of drawers, said guide means extending generally parallel to its adjacent row of drawers and having an aperture therethrough; said interconnecting cable extending through said aperture and being guided thereby.

11. The interlock mechanism of claim 1 wherein said first and second interlocking means include elongated, flexible means for extending along said first and second rows of drawers and including a predetermined amount of slack, said movement restricting means including rigid means adjacent each of said drawers for engaging said flexible means to remove said slack when the drawer adjacent one of said rigid means is opened, said amount of slack being sufficient to allow opening of only one of said drawers in either row at one time.

12. A cabinet assembly having at least two adjacent rows of drawers and interlock system allowing only one drawer in both said rows to be open at a time, said interlock system comprising: an elongated flexible member extending from a first fixed position adjacent one row of drawers to a second fixed position adjacent an adjacent row of drawers, said member being positioned to extend from said first fixed position along each of the drawers in said one row and extending along each of the drawers in said adjacent row to said second fixed position, said member including a portion extending between said rows, said member being dimensioned to include a predetermined amount of slack when all the drawers in both rows are closed; cam means in said cabinet assembly adjacent each of said drawers and said flexible member, each cam means movable between a first position in which it does not take up any slack in said flexible member and a second position in which it takes up generally all the slack in said flexible member, said flexible member resisting movement of all said cam means except one when said one cam means is in its second position; abutment means on each of said drawers, each of said abutment means cooperatively engageable with one of said cam means to move said one cam means from said first position to said second position into engagement with said flexible member as a drawer is moved from a closed position to remove said slack from said flexible member in each of said adjacent rows thereby resisting movement of the additional cam means and causing said additional cam means and said additional abutment means to act as stops to prevent movement of any additional drawer.

13. A drawer interlock of claim 12 wherein said first fixed point is proximate an uppermost drawer in said one of said rows; said second fixed point is proximate an uppermost drawer in said adjacent row of drawers;

and wherein said flexible member extends from said first fixed point downwardly along said drawers in said one row, across a lowermost surface of said first row and upwardly in said adjacent row to said second fixed position.

14. The interlock system as defined in claim 13 and further including adjustment means in said cabinet assembly for taking up excessive slack in said flexible member to thereby adjust the tension thereon.

15. The interlock system of claim 14 wherein said adjustment means includes a guide member engaging said flexible member, said guide member being positioned below said lowermost drawer in said one of said rows.

16. In an assembly of two cabinets including a first cabinet having a plurality of drawers and a drawer interlock mechanism, said interlock including a stop member mounted on the cabinet adjacent a plurality of drawers and movable between slack and taut positions; a cam mounted to the cabinet adjacent each of said drawers and adjacent said stop member; and cooperating means on said cam and said drawer operable to move said cam into said stop member when the drawer is moved from a closed position in the cabinet, said stop member dimensioned such that movement of one of said cams into said stop member takes up the slack in said member and said stop member restricts movement of additional cams causing said cooperating means to act as a stop preventing movement of an additional drawer, the improvement comprising: a like cabinet positioned adjacent said first cabinet, said like cabinet having a plurality of drawers and a like interlock mechanism positioned adjacent said first mentioned cabinet, said like interlocking mechanism including a like stop member, like cams adjacent each of said drawers in said like cabinet, and like cooperating means on said cams and drawers of said like cabinet; and means connecting said stop member of said interlock mechanism in said one of said cabinets and said like stop member of said like interlock mechanism in said like cabinet for permitting the slack to be taken up from both of said stop members upon movement of one of said drawers and cams thereby preventing the opening of additional drawers in said first cabinet and in said like adjacent cabinet.

17. The interlock mechanism of claim 16 wherein said stop member comprises a flexible cable member extending from a first fixed position in said first mentioned cabinet to a second fixed position in said like cabinet.

18. The interlock system of claim 17 and further including adjustment means in one of said first mentioned cabinet and said like cabinet for taking up excessive slack in said cable member.

19. The interlock system of claim 18 wherein said adjustment means includes a laterally adjustable guide member engaging said flexible member.

20. The interlock system of claim 19 and further including said guide member including means forming a channel surrounding said cable and means retaining said cable in said channel.

21. The interlock system of claim 20 wherein said channel includes a top wall and a pair of sidewalls forming an open bottom elongated enclosure for said cable and wherein said retaining means includes a pair of legs on said guide member adjacent the ends and bottom of said elongated enclosure to retain said cable therein.

* * * * *

Disclaimer 3,941,441.—*Douglas Scheerhorn,* Grand Rapids, Mich. DRAWER INTERLOCK SYSTEM. Patent dated Mar. 2, 1976. Disclaimer filed Sept. 19, 1983, by the assignee, *Steelcase, Inc.*

Hereby enters this disclaimer to claim 1 of said patent.

[*Official Gazette November 22, 1983.*]